US010665383B2

(12) United States Patent
Sun

(10) Patent No.: US 10,665,383 B2
(45) Date of Patent: May 26, 2020

(54) MANUFACTURING METHOD FOR ELECTROSTATICALLY TUNABLE MAGNETOELECTRIC INDUCTORS WITH LARGE INDUCTANCE TUNABILITY

(71) Applicant: Winchester Technologies, LLC., Winchester, MA (US)

(72) Inventor: Nian-Xiang Sun, Winchester, MA (US)

(73) Assignee: Winchester Technologies, LLC., Winchester, MA (US)

( * ) Notice: Subject to any disclaimer, the term of this patent is extended or adjusted under 35 U.S.C. 154(b) by 0 days.

(21) Appl. No.: 15/603,816

(22) Filed: May 24, 2017

(65) Prior Publication Data

US 2018/0075966 A1 Mar. 15, 2018

Related U.S. Application Data

(62) Division of application No. 14/241,032, filed as application No. PCT/US2012/051579 on Aug. 20, 2012, now Pat. No. 9,691,544.

(Continued)

(51) Int. Cl.
*H01F 29/14* (2006.01)
*H01F 41/04* (2006.01)

(Continued)

(52) U.S. Cl.
CPC ..... *H01F 29/146* (2013.01); *H01F 21/08* (2013.01); *H01F 27/2804* (2013.01);

(Continued)

(58) Field of Classification Search
CPC .... H01F 41/041; H01F 41/042; H01F 41/043; H01F 41/046; H01F 41/14; H01F 41/32;

(Continued)

(56) References Cited

U.S. PATENT DOCUMENTS 3,614,554 A 10/1971 Shield et al.
3,858,138 A 12/1974 Gittleman et al.

(Continued)

FOREIGN PATENT DOCUMENTS

JP 08288143 A * 11/1996
JP 11040427 A * 2/1999
JP 2000296612 A * 10/2000 ..... H01F 21/08

OTHER PUBLICATIONS

Machine Translation of Japanese Patent Publication, JP 2000-296612, (English), Apr. 2019.*

(Continued)

*Primary Examiner* — A. Dexter Tugbang
(74) *Attorney, Agent, or Firm* — Foley & Lardner LLP

(57) ABSTRACT

A method of manufacturing an electrostatically tunable magnetoelectric inductor, the method includes forming a piezoelectric layer on a substrate. The method further includes forming a magnetoelectric structure over the piezoelectric layer by: forming a first electrically conductive layer disposed above the piezoelectric layer; forming an isolation layer configured to translate changes in strain; forming a magnetic film layer disposed over the isolation layer; and forming a second electrically conductive layer, disposed over the magnetic film layer and wherein the second electrically conductive layer is in electrical communication with the first electrically conductive layer so as to form at least one electrically conductive coil around the magnetic film layer.

11 Claims, 4 Drawing Sheets

Related U.S. Application Data

(60) Provisional application No. 61/524,913, filed on Aug. 18, 2011.

(51) Int. Cl.

| | |
|---|---|
| ***H01F 41/34*** | (2006.01) |
| ***H01F 21/08*** | (2006.01) |
| ***H01F 27/28*** | (2006.01) |
| ***H01F 41/14*** | (2006.01) |
| ***H01F 41/32*** | (2006.01) |
| *H01F 10/26* | (2006.01) |

(52) U.S. Cl.

CPC ..... *H01F 41/041* (2013.01); *H01F 41/042* (2013.01); *H01F 41/043* (2013.01); *H01F 41/046* (2013.01); *H01F 41/14* (2013.01); *H01F 41/32* (2013.01); *H01F 41/34* (2013.01); *H01F 10/265* (2013.01); *H01F 2027/2809* (2013.01); *H01F 2027/2814* (2013.01); *H01F 2027/2819* (2013.01); *Y10T 29/42* (2015.01); *Y10T 29/4902* (2015.01); *Y10T 29/49021* (2015.01)

(58) Field of Classification Search

CPC ..... H01F 41/34; H01F 2027/2809; H01F 2027/2814; H01F 2027/2819; H01F 10/265; H01F 21/08; H01F 29/146; H01F 27/2804; Y10T 29/42; Y10T 29/4902; Y10T 29/49021

See application file for complete search history.

(56) References Cited

U.S. PATENT DOCUMENTS

| | | | | |
|---|---|---|---|---|
| 6,037,649 | A | 3/2000 | Liou | |
| 6,042,707 | A * | 3/2000 | Moslehi ..... | C23C 14/22 118/723 FE |
| 6,065,353 | A | 5/2000 | Hirabayashi et al. | |
| 6,759,727 | B2 | 7/2004 | Ju | |
| 7,144,101 | B2 | 12/2006 | Ifuku et al. | |
| 7,146,861 | B1 | 12/2006 | Cook et al. | |
| 7,170,384 | B2 | 1/2007 | Kim et al. | |
| 7,250,831 | B2 | 7/2007 | Song et al. | |
| 7,262,680 | B2 | 8/2007 | Wang | |
| 7,310,029 | B2 | 12/2007 | Robert et al. | |
| 7,608,975 | B2 * | 10/2009 | Orlando ..... | H01F 21/08 310/311 |
| 7,694,551 | B2 | 4/2010 | Jakoby | |
| 7,800,278 | B2 | 9/2010 | Ujihara et al. | |
| 8,134,444 | B2 | 3/2012 | Horiuchi et al. | |
| 8,143,987 | B2 | 3/2012 | Kireev | |
| 8,797,711 | B2 | 8/2014 | Matsumoto et al. | |
| 2002/0104990 | A1 | 8/2002 | Dereus et al. | |
| 2003/0000058 | A1 | 1/2003 | Tsai et al. | |
| 2003/0021004 | A1 | 1/2003 | Cunningham et al. | |
| 2005/0028336 | A1 | 2/2005 | Robert et al. | |
| 2006/0091608 | A1 | 5/2006 | Yercha et al. | |
| 2006/0256167 | A1 | 11/2006 | Ifuku et al. | |
| 2007/0045773 | A1 | 3/2007 | Mi et al. | |
| 2008/0068759 | A1 | 3/2008 | Orlando et al. | |
| 2008/0303624 | A1 | 12/2008 | Yamada et al. | |
| 2009/0189486 | A1 | 7/2009 | Matsuki | |
| 2009/0243780 | A1 * | 10/2009 | Inoue ..... | H01F 1/15366 336/200 |
| 2009/0277300 | A1 | 11/2009 | Matsuki | |
| 2010/0277037 | A1 * | 11/2010 | Fukano ..... | H03H 9/059 310/313 C |
| 2011/0128602 | A1 | 6/2011 | Hamano et al. | |
| 2011/0205173 | A1 | 8/2011 | Arai | |
| 2011/0234351 | A1 | 9/2011 | Kawarai et al. | |

OTHER PUBLICATIONS

Chinese Office Action on Appln. Ser. No. 2012800511951 dated Jun. 2, 2016 (6 pages).

Chinese Office Action on Appln. Ser. No. 2012800511951 dated Nov. 3, 2015 (20 pages).

International Preliminary Report on Patentability on Appln. Ser. No. PCT/US2012/051579 dated Feb. 18, 2014 (6 pages).

International Search Report & Written Opinion on Appln. Ser. No. PCT/US2012/051579 dated Nov. 2, 2012 (7 pages).

Third Chinese Office Action on Appln. Ser. No. 201280051195.1 dated Oct. 25, 2016 (16 pages).

U.S. Notice of Allowance on U.S. Appl. No. 14/241,032 dated Feb. 24, 2017 (9 pages).

U.S. Office Action on U.S. Appl. No. 14/241,032 dated Apr. 26, 2016 (11 pages).

U.S. Office Action on U.S. Appl. No. 14/241,032 dated Jul. 27, 2016 (11 pages).

U.S. Office Action on U.S. Appl. No. 14/241,032 dated Sep. 22, 2015 (11 pages).

* cited by examiner

FIG. 4

| Tunability - Material Combinations | | | | |
|---|---|---|---|---|
| Piezoelectric / Multiferroic | PZT | | PMN-PT | |
| | ΔL/L | Q | ΔL/L | Q |
| MEMs Inductors | ΔL/L = 40%, Q = 5 | | | |
| Metglas | 900 % | 30 | 12000% | 100 |
| Terfenol | 300% | 30 | 800% | 100 |
| Galfenol | 1500% | 30 | 13000% | 100 |
| Mn-Zn ferrite | 150% | ~50 | 2400% | ~200 |

MANUFACTURING METHOD FOR ELECTROSTATICALLY TUNABLE MAGNETOELECTRIC INDUCTORS WITH LARGE INDUCTANCE TUNABILITY

CROSS-REFERENCE TO RELATED PATENT APPLICATION

The present application is a divisional of and claims priority to U.S. patent application Ser. No. 14/241,032, entitled "ELECTROSTATICALLY TUNABLE MAGNETOLECTRIC INDUCTORS WITH LARGE INDUCTANCE TUNABILITY", filed Feb. 25, 2014, which in turn is a national stage entry of and claims priority to PCT/US2012/51579, entitled "ELECTROSTATICALLY TUNABLE MAGNETOLECTRIC INDUCTORS WITH LARGE INDUCTANCE TUNABILITY" filed Aug. 20, 2012, which in turn claims priority to and benefit of U.S. Provisional Application 61/524,913, entitled "ELECTROSTATICALLY TUNABLE MAGNETOLECTRIC INDUCTORS WITH LARGE INDUCTANCE TUNABILITY AND IMPROVED PERFORMANCE" all of which are incorporated herein by reference in their entirety.

BACKGROUND

The present disclosure relates generally to tunable magnetoelectric inductors with large inductance tunability and a method of manufacturing such inductors. The invention also relates to semiconductor devices containing tunable magnetoelectric inductors.

Incorporating tunability in conventional RF front-end components allows for the development of radio architectures capable of operating over multiple bands and standards, resulting in a reduction in cost, size, complexity, and power consumption of the radio transceiver. Front-end components such as tunable filters, phase shifters, voltage controlled oscillators, tunable low-noise amplifiers, and other RF components use on-chip and off-chip passive electronic components. Inductors, as one of the three fundamental components for electronic circuits, are extensively used in these front-end components as well as in other electronic applications. Tunable inductors, especially tunable inductors suitable for use in RF circuits, are key elements in creating intelligent, reconfigurable radios. While electronically tunable capacitors and resistors have been widely used for such tasks, electronically tunable inductors have not been readily available, despite the broad range of uses for such inductors.

Different technologies have been explored for tunable RF inductors, including inductors with magnetic materials where the permeability can be tuned by a magnetic field, inductors with magnetic materials where the permeability can be tuned by changing the coupling of the inductor coil and the magnetic core, inductors where the winding is digitally controlled via MEMS switches, mechanical tuning of mutual inductance between coupled inductors, varactor-based tunable inductors created by connecting a varactor with a fixed inductor so as to vary the bias voltage applied across the varactor and thus tuning the effective inductance, and manually tuned inductors. Each of these tunable inductor technologies has shortcomings that prevent general and widespread acceptance. Magnetic field tuning requires significant power and a constant current. Mechanical tuning requires large, complex actuators which are difficult to fabricate. Switchable inductors are limited by the number of switches used and the number of switches is limited as increasing this number reduces inductor quality. Varactor-tuned inductors have low quality factors and limited tunability. Manually tuned inductors are inconvenient to use. These negative aspects to currently available tunable inductors limit their usage.

SUMMARY OF THE INVENTION

An electrostatically tunable inductor with a wide range of tunable inductance that does not require complex mechanical actuators or switches and does not require significant consumption of power or an ongoing constant current draw is described.

In one or more embodiments, the electrostatically tunable inductor comprises a piezoelectric layer disposed above a substrate. Disposed above the piezoelectric layer is a magnetoelectric structure, comprising a first electrically conductive layer, a magnetic film layer adjacent to the first electrically conductive layer, and a second electrically conductive layer electrically connected to the first electrically conductive layer. A method of manufacture is also disclosed.

In one aspect, the electrostatically tunable inductor is manufactured by forming a piezoelectric layer disposed above a substrate. Disposed above the piezoelectric layer is a magnetoelectric structure, formed of a first electrically conductive layer, a magnetic film layer adjacent to the first electrically conductive layer, and a second electrically conductive layer electrically connected to the first electrically conductive layer.

The electrostatically tunable inductor is manufactured using techniques that are adapted from semiconductor manufacturing and allow the incorporation and/or integration of tunable inductor devices into semiconductor devices. In one or more embodiments, the tunable inductor is incorporated into the semiconductor device during the manufacture and assembly of the device.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which:

FIG. 4 is a table of tunability and quality factors of the tunable magnetoelectric inductor of FIG. 1 using different magnetic and piezoelectric materials, in accordance with certain embodiments.

DETAILED DESCRIPTION

Figure 1:
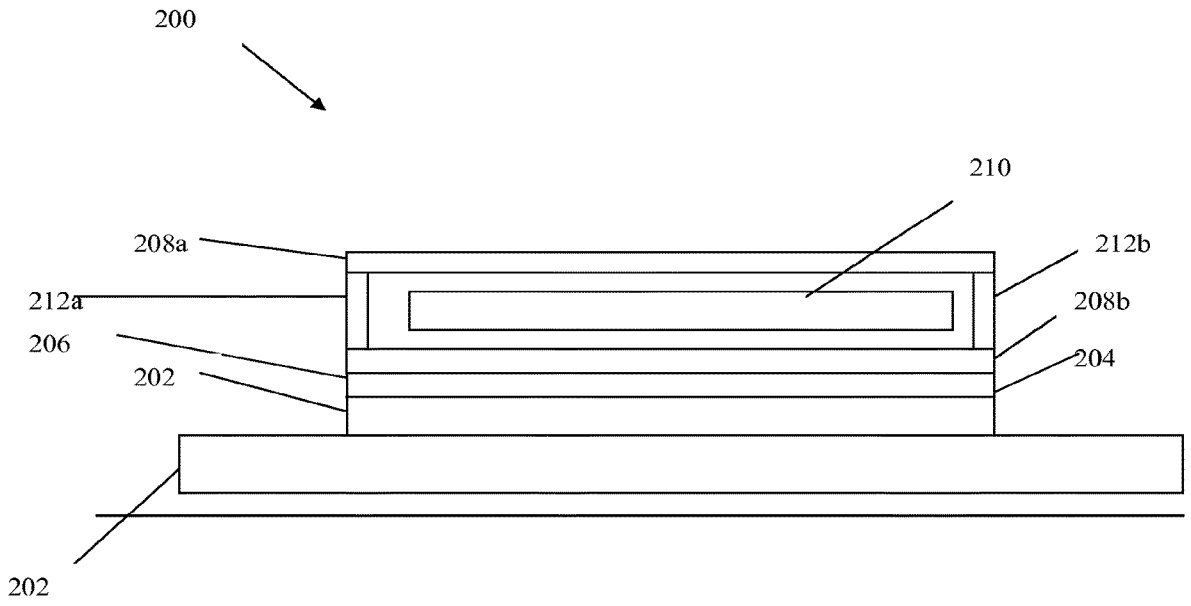
FIG. 1 is a schematic illustration of an electrostatic tunable inductor according to one or more embodiments.

The present disclosure provides for tunable magnetoelectric inductors with large inductance tunability and improved performance over the prior art. Additionally, the present disclosure provides for a method of manufacturing such an inductor suitable for integration into standard semiconductor manufacturing processes. Unlike other tunable inductors, the electrostatically tunable magnetoelectric inductor of this disclosure displays a tunable inductance range of >5:1 while consuming less than 0.5 mJ of power in the process of tuning, does not require continual current to maintain tuning, and does not require complex mechanical components such as actuators or switches.

A magnetoelectric inductor 200 according to one or more embodiments is described with reference to FIG. 1. In certain embodiments the magnetoelectric inductor includes a substrate 202 such as silicon, sapphire, or such other substrates as may be used in semiconductor manufacturing processes. The inductor includes a piezoelectric layer 204, composed of a piezoelectric material. A first isolation layer 206 composed of an isolation material such as silicon dioxide or other conventional dielectric material is deposited over the piezoelectric material. The isolation layer separates the piezoelectric material from the magnetoelectric structure, but provides a means for translating the changes in strain from the piezoelectric layer to the magnetic structure. A magnetoelectric structure, such as a magnetic solenoid or toroid inductor, is arranged above the piezoelectric layer. The magnetoelectric structure includes conductive metal layers 208*a*, 208*b* such as copper, aluminum, silver or other conductive metal which are deposited above and below a high permeability magnetic film 210 to form a solenoid coil. A solenoid is a magnetic field coil which produces a fairly uniform magnetic field in its interior. Like all current carrying devices, it has inductance in proportion to the volume integral of the square of the magnetic field for a give current. Solenoids are typically formed by helically winding a conductive wire into a coil. In the current embodiment, the solenoid coil is formed by joining patterned upper and lower conductive layer using vias 212*a*, 212*b* to provide a coiled conductive pathway around the magnetic film layer.

After deposition, the magnetic film is magnetically annealed to align magnetic domains and patterned to enhance the permeability of the material. In one or more embodiments, each of the layers in the magnetoelectric inductor are spaced apart from one another by an isolation layer. This structure leads to enhanced tunable inductance range and quality factor over previous tunable inductors integrated into semiconductor devices.

Figure 2A:
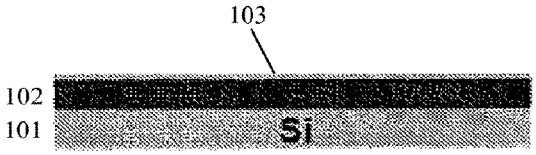
FIG. 2A, FIG. 2B, FIG. 2C, FIG. 2D, FIG. 2E, and FIG. 2F are process cross-sectional views illustrating an electrostatically tunable magnetoelectric inductor and a method for manufacturing such a device according to certain embodiments.
Figure 2B:
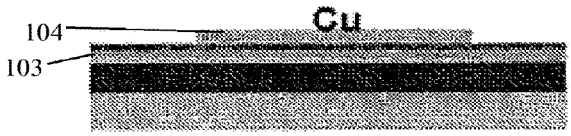
Figure 2C:
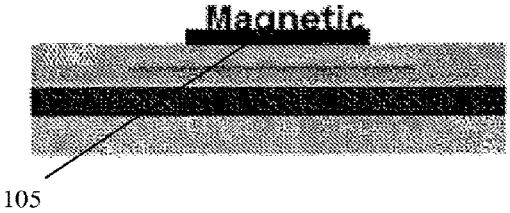
Figure 2D:
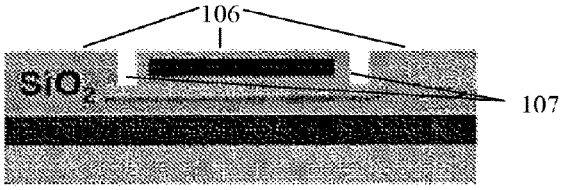
Figure 2E:
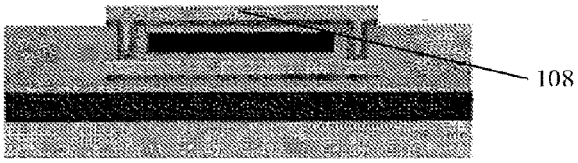
Figure 2F:
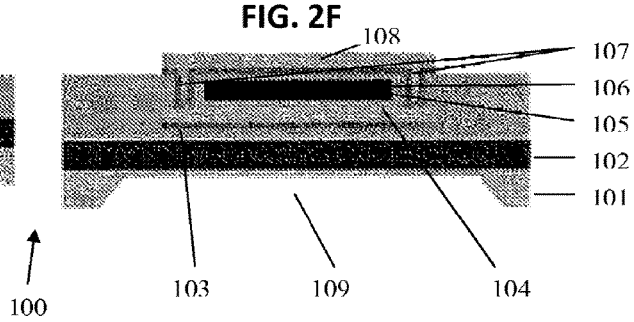

FIG. 2F is a schematic of an electrostatically tunable magnetoelectric inductor 100 in accordance with certain embodiments. The inductor 100 includes a substrate layer 101 and a piezoelectric layer 102 above substrate layer 101. A first isolation layer 103 is above the piezoelectric layer 102. A first electrically conducting layer 104 is above the first isolation layer 103. In some embodiments, the first electrically conducting layer is patterned. A magnetic film layer 105 is above the first electrically conducting layer 104. In some embodiments, the magnetic film layer 105 is annealed to align magnetic domains and patterned. In some embodiments, the patterning is performed by etching. A second isolation layer 106 is above the magnetic film layer 105 and the first electrically conducting layer 104.

In some embodiments, recesses 107 are formed in the second isolation layer. The recesses 107 are formed so at penetrate the second isolation layer 106 and expose a surface of the first electrically conducting layer 104. While two recesses 107 are shown in device 100, any number of recesses may be used for a particular device (e.g., 1, 3, etc.). A second electrically conducting layer 108 is above at least part of the second isolation layer 106, and is so placed as to fill the at least one recess 107 and contact the first electrically conducting layer 104. In some embodiments, the second electrically conducting layer 108 is patterned. In some embodiments, the patterning of the first electrically conducting layer 104 and the second electrically conducting layer 108 are arranged, in combination with the arrangement of the recesses 107, so as to form at least one coil around the magnetic film layer 109. In some embodiments, a portion of the substrate 101 below the piezoelectric layer is thinner than the portion of the substrate not below the piezoelectric layer 109 in order to maximize the deformation of the piezoelectric layer for a given induced electric field.

Further, the configurations shown in FIG. 1 and FIG. 2F are intended to be exemplary and is not intended to be limiting. One of skill can appreciate that other variations of electrostatically tunable magnetoelectric inductors can be engineered according to the principles described herein without departing from the spirit of the description. Further, one of skill can appreciate that other electrostatically tunable magnetoelectric devices than inductors can be engineered according to the principles described herein without departing from the spirit of the description.

In some embodiments, the substrate layer 101 is composed of silicon. In other embodiments, it may be composed of gallium arsenide, gallium nitride, sapphire, or another substrate material. In some embodiments, the piezoelectric layer 102 is a layer of lead zirconate titanate (PZT) of about 1 to 20 μm thickness, placed on the substrate. Doping of these lead zirconatc-titanatc ceramics (PZT) with, for example, Ni, Bi, Sb, Nb ions etc., make it possible to adjust individual piezoelectric and dielectric parameters as required. Other exemplary piezoelectric materials include PMN-PT (lead manganese niobate-lead titanate), PZN-PT (lead zinc niobate-lead titanate), $BaTiO_3$, (Ba,Sr)TiO3, ZnO, and AlN. In some embodiments, the layer of lead zirconate titanate is composed of lead zirconate titanate with a ratio of about 52 parts zircon to 48 parts titanium. In other embodiments, the piezoelectric layer 102 is a layer of lead magnesium niobate-lead titanate. In some embodiments, the layer of lead magnesium niobate-lead titanate is composed of lead magnesium niobate-lead titanate with a ratio of about 65 parts lead magnesium niobate to 35 parts lead titanate. In some embodiments, the layer of lead zirconate titanate is of a thickness of about 5 to 10 μm. In some embodiments, the first isolation layer 103 and second isolation layer 106 are composed of silicon dioxide. In some embodiments, the first electrically conducting layer 104 and second electrically conducting layer 108 are composed of copper. Exemplary magnetic materials or magnetic/non-magnetic insulator multilayers include those having high permeability, low loss tangent, and high resistivity. In some embodiments, the magnetic film layer 105 is composed of Metglas 2605CO™. In other embodiments, the magnetic film layer 105 is composed of galfenol, terfenol, CoFeB, CoFeN, CoFe, or ferrites with a thickness based on the inductance required and the magnetoelectric strain change of the material.

A method of manufacturing an electrostatically tunable magnetoelectric inductor with large inductance tunability is also disclosed. As shown in FIG. 2A, a piezoelectric layer 102 is formed on a substrate 101. After the piezoelectric layer 102 is formed, a first isolation layer 103 is formed on the piezoelectric layer 102. In some embodiments, the piezoelectric layer 102 and first isolation layer 103 are formed by chemical vapor deposition. As shown in FIG. 2B, after the first isolation layer 103 is formed, a first electrically conducting layer 104 is formed on the first isolation layer 103. In some embodiments, the first electrically conducting layer is formed by sputtering of a copper seed layer, followed by application of photoresist and electrodeposition of a copper layer. In some embodiments, the photoresist is patterned so as to deposit the first electrically conducting layer in a pattern.

Then, as shown in FIG. 2C, a magnetic film layer 105 is formed on the first electrically conducting layer 104. In some embodiments, the magnetic film layer is formed by sputtering. In some embodiments, the magnetic film layer 105 is annealed after it is formed to align the magnetic domains within the magnetic film layer 105. Annealing increases the permeability of the magnetic film layer. In some embodiments, the magnetic film layer 105 is patterned. In some embodiments, patterning of the magnetic film layer 105 into different geometries such as long stripe structures either along the length or width direction is achieved by etching. Patterning is used for adjustment of the magnetic anisotropy and achieving appropriate inductance and operation frequency. As shown in FIG. 2D, after deposition and optional annealing and patterning of the magnetic film layer 105, a second isolation layer 106 is formed on the magnetic film layer 105. In some embodiments, the second isolation layer 106 is deposited via chemical vapor deposition.

In some embodiments, as shown in FIG. 2D, recesses 107 are then formed on the second isolation layer 106. The recesses 107 are formed so as to penetrate the second isolation layer 106 and expose a main surface of the first electrically conducting layer 104 at a bottom portion of the recess 107. In some embodiments these recesses are formed via application of masked photoresist and etching of the second isolation layer 106. In some embodiments the mask used to apply photoresist is patterned. In some embodiments the photoresist mask pattern is so disposed as to form vias through which the first and second layer may be in electrical communication with one another. In further embodiments, the photoresist mask pattern is so disposed, in conjunction with the patterning of the first and second electrically conductive layers, as to arrange the vias and the electrically conductive layers in at least one coil formed around the magnetic film layer. In some embodiments, as shown in FIG. 2E, a second electrically conducting layer 108 is formed to cover at least part of the second isolation layer. In some embodiments, the second electrically conducting layer 108 is formed by sputtering of a copper seed layer, followed by application of photoresist and electrodeposition of a copper layer. In some embodiments, the photoresist is patterned so as to deposit the second electrically conducting layer 108 in a pattern. In some embodiments, as shown in FIG. 2F, the substrate 101 is removed below the magnetic film layer 105. In some embodiments, the substrate 101 is removed by etching of the substrate 101. Removal of the substrate 101 below the piezoelectric layer 102 helps to enhance deformation of the piezoelectric layer 102, thus increasing deformation of the magnetic film layer 105. By increasing this deformation, the change in permeability of the magnetic film layer 105 is increased and tunability of the completed electrostatically tunable magnetoelectric inductor 100 is enhanced.

Figure 3A:
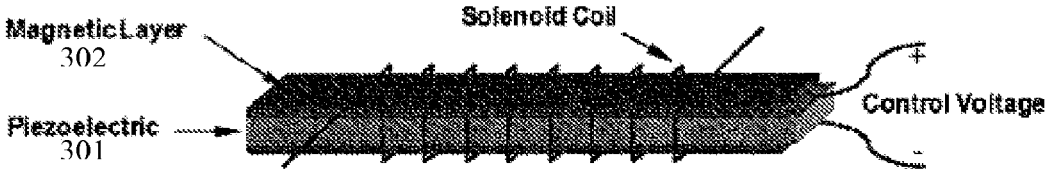
FIG. 3A and FIG. 3B are schematics of a multilayer magnetic/piezoelectric material showing the mechanism by which an electric field induces a magnetic field.
Figure 3B:
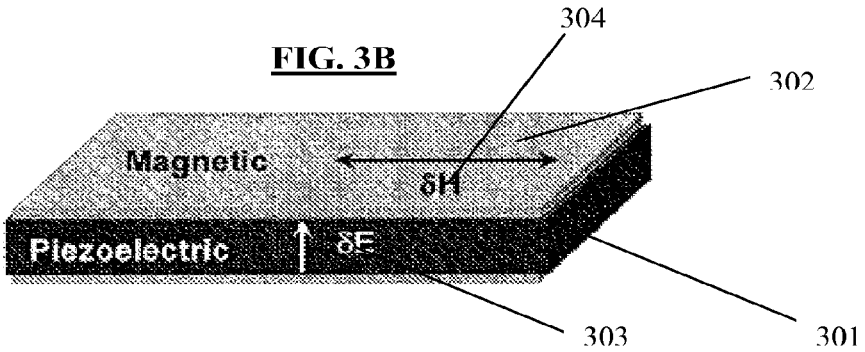

As shown in FIGS. 3A-3B, induction of an electric field in the piezoelectric layer 301 can induce a magnetic field in the magnetic film layer 302. FIG. 3A shows the magnetic film device prior to induction of an electric field, with piezoelectric layer 301 and magnetic film layer 302 not deformed. Without an electric field applied, the inductance of the inductor rolls off quickly at higher frequencies (>10 kHz). This roll off is associated with the large eddy current loss in the magnetic film layer, leading to reduced effective permeability at high frequencies and thus lower inductance. As shown in FIG. 3B, when an electric field 303 is applied along the thickness direction of the piezoelectric layer 301, the piezoelectric layer 301 will deform in plane of the piezoelectric layer 301. This deformation will be transferred to the magnetic film layer 302, either directly or through intervening layers, inducing anisotropic magnetic fields 304 due to the inverse magnetoelectric effect. The anisotropy can be expressed by the following equation:

$$H_{eff} = H_a + H_{ME} = H_a + \frac{3\lambda_s Y d_{31} E}{M_s} \tag{1}$$

where $H_a$ is the intrinsic anisotropy, $H_{ME}$ is the induced anisotropy field due to magnetoelectric coupling, $\lambda_s$ is the saturation magnetostriction constant, Y is the Young's modulus, $d_{31}$ is the piezoelectric coefficient of the piezoelectric layer, E is the electric field across the piezoelectric layer, and $M_s$ is the saturation magnetization of the magnetic layer. The converse magnetoelectric coupling coefficient is thus expressed by the following equation:

$$\alpha_{ME} = \frac{3\lambda_s Y d_{31}}{M_s} \tag{2}$$

From the effective magnetic anisotropy, the effective relative permeability of the magnetic film layer can be expressed as:

$$\mu_r = \frac{4\pi M_s}{H_{eff}} + 1 \tag{3}$$

and the inductance can be calculated as:

$$L = \mu_0 \frac{2\mu_r t + d}{d} \frac{N^2 A}{l} \tag{4}$$

where N is the number of turns of coil around the magnetic film layer, A is the cross-sectional area of the coil around the magnetic film layer, l is the length of the coil around the magnetic film layer, t is the thickness of the magnetic film layer, and d is the height of the magnetic film layer. Because effective magnetic anisotropy varies with induced electric field across the piezoelectric, effective relative permeability varies with effective magnetic anisotropy, and inductance varies with effective relative permeability, application of an electric field across the piezoelectric layer produces variation in inductance, enabling tunability of the magnetoelectric inductor. A strong electric field dependence of the inductance can be observed, with inductance decreasing rapidly at higher electric fields.

A high converse magnetoelectric coupling coefficient is desirable for achieving large tunability in tunable magnetoelectric inductors. Piezoelectric materials with a high piezoelectric coefficient and magnetic materials with a high saturation magnetostriction constant and low saturation magnetization are desirable to achieve a stronger converse magnetoelectric coupling coefficient and thus a greater tunable inductance range. It is also desirable that the magnetic material have a low loss tangent in order to improve the quality factor Q of the tunable inductor. Quality factor also varies with application of electric field, as the reduced permeability achieved at higher electric fields leads to increased skin depth and reduced core eddy current loss in combination with the increased peak quality factor frequency, also due to reduced permeability. At lower frequencies, inductance tunability is much greater as eddy current loss is not significant.

Tuning of the electrostatically tunable magnetoelectric inductor 100 is thus accomplished by deformation of the piezoelectric layer 102 via an electric field across the piezoelectric layer. Deformation of the piezoelectric layer 102 induces a deformation of the magnetic film layer 105. Deformation of the magnetic film layer 105 then leads to an effective magnetic anisotropy field due to the inverse magnetoelastic effect. This anisotropy field leads to a change in relative permeability of the magnetic film layer 105 and thus to a change in inductance L of the electrostatically tunable magnetoelectric inductor 100 as per equations 1-4 above. The inductance L of the electrostatically tunable magnetoelectric inductor 100 varies as per equation 4 above directly as a function of the relative permeability of the magnetic film layer 105, which can be calculated by equation 3, where $M_s$ is the saturation magnetization of the magnetic film layer 105 and $H_{eff}$ is the total effective anisotropy field in the magnetic film layer 105. Thus inducing deformation of the piezoelectric layer 102 leads to tuning of the inductance of the electrostatically tunable magnetoelectric inductor 100. A tunable inductance range of >5:1 with low power consumption is achieved.

Deformation of the piezoelectric layer 102 within the device is advantageously achieved by taking advantage of the capacitive properties of the piezoelectric layer 102. An applied voltage across the piezoelectric layer 102 can lead to a piezoelectric strain, which leads to a strain in the magnetic material, and therefore a change of the permeability. The electrical energy required to induce an applied voltage can be estimated from the energy associated with charging a piezoelectric capacitor, expressed as $E=\frac{1}{2} CV^2$, where C is the capacitance associated with the piezoelectric layer and V is the voltage to be induced across the piezoelectric layer. The stored electrical energy induces a voltage across the thickness of the piezoelectric layer 102 corresponding to an electric field across the piezoelectric layer 102 dependent on the thickness of the piezoelectric layer 102 and the voltage. The induced electric field deforms the piezoelectric layer 102 via the piezoelectric effect. By varying the stored charge, the induced electric field varies, which in turn varies the relative permeability. Variation of relative permeability allows tuning of inductance. As charge leakage from the piezoelectric layer 102 can be made negligibly small, tuning does not require the continual induction of an electric field but rather can be accomplished by one time induction of a charge across the piezoelectric layer.

Upon review of the description and embodiments of the present invention, those skilled in the art will understand that modifications and equivalent substitutions may be performed in carrying out the invention without departing from the essence of the invention. Thus, the invention is not meant to be limiting by the embodiments described explicitly above, and is limited only by the claims which follow.

What is claimed is:

1. A method of manufacturing an electrostatically tunable magnetoelectric inductor, the method comprising:

forming a piezoelectric layer comprising piezoelectric material on a substrate;

forming a magnetoelectric structure over the piezoelectric layer by:

forming an isolation layer directly on the piezoelectric material of the piezoelectric layer, the isolation layer configured to translate changes in strain from the piezoelectric material;

forming a first electrically conductive layer disposed above the piezoelectric layer;

forming a magnetic film layer disposed over the isolation layer; and forming a second electrically conductive layer, disposed over the magnetic film layer, wherein the second electrically conductive layer is in electrical communication with the first electrically conductive layer so as to form at least one electrically conductive coil around the magnetic film layer.

2. The method of claim 1, further comprising forming at least one recess wherein the at least one recess is formed so as to allow the first and second electrically conductive layers to be in electrical communication with each other.

3. The method of claim 2, wherein the recesses are formed by application of a photoresist and etching.

4. The method of claim 3, wherein the photoresist is patterned.

5. The method of claim 2, wherein the first and second electrically conductive layers are patterned after deposition so as to form the at least one electrically conductive coil around the magnetic film layer.

6. The method of claim 5, wherein the patterning of the first and second electrically conductive layers is performed by etching.

7. The method of claim 1, further comprising annealing the magnetic film layer.

8. The method of claim 1, further comprising patterning the magnetic film layer.

9. The method of claim 8, wherein the patterning of the magnetic film layer is performed by etching.

10. The method of claim 1, further comprising removing a portion of the substrate from below the magnoelectric structure.

11. The method of claim 1, wherein the magnetic film layer is composed of a multilayer magnetic material.

* * * * *